US005962102A

United States Patent [19]

Sheffield et al.

[11] Patent Number: 5,962,102

[45] Date of Patent: Oct. 5, 1999

[54] LOOP MATERIAL FOR ENGAGEMENT WITH HOOKING STEMS

[75] Inventors: William F. Sheffield, Oakdale; John L. Barry, Inver Grove Heights; David F. Slama, Vadnais Heights, all of Minn.

[73] Assignee: 3M Innovative Properties Company, St. Paul, Minn.

[21] Appl. No.: 08/979,457

[22] Filed: Nov. 26, 1997

Related U.S. Application Data

[62] Division of application No. 08/560,491, Nov. 17, 1995, Pat. No. 5,692,949.

[51] Int. Cl.[6] ..... B32B 3/06

[52] U.S. Cl. ..... 428/92; 428/95; 428/100; 428/101

[58] Field of Search ..... 428/92, 95, 100, 428/101

[56] References Cited

U.S. PATENT DOCUMENTS

| | | | |
|---|---|---|---|
| 2,048,413 | 7/1936 | Spesso | 112/1 |
| 3,253,426 | 5/1966 | Mauersberger | 66/84 |
| 3,309,900 | 3/1967 | Wünsch et al. | 66/85 |
| 3,346,904 | 10/1967 | Armstrong | 15/230.12 |
| 3,452,561 | 7/1969 | Stousland et al. | 66/195 |
| 3,577,607 | 5/1971 | Ikoma et al. | 24/204 |
| 3,592,025 | 7/1971 | Sharpe | 66/192 |
| 3,602,011 | 8/1971 | Barton et al. | 66/85 |
| 3,695,987 | 10/1972 | Wistotzky et al. | 428/94 |
| 3,835,508 | 9/1974 | Bini | 24/204 |
| 3,869,850 | 3/1975 | Gross | 57/24 |
| 3,889,034 | 6/1975 | Lenards et al. | 428/372 |
| 3,910,075 | 10/1975 | Holliday | 66/192 |
| 3,929,268 | 12/1975 | Gross | 226/176 |
| 3,969,881 | 7/1976 | Boldrini | 57/24 |
| 4,184,291 | 1/1980 | Marton | 51/170 R |
| 4,189,931 | 2/1980 | Groshens | 66/193 |
| 4,228,566 | 10/1980 | Matsuda | 24/205.16 |
| 4,263,755 | 4/1981 | Globus | 451/538 |
| 4,287,685 | 9/1981 | Marton | 51/170 T |
| 4,288,973 | 9/1981 | Tani | 57/24 |
| 4,297,858 | 11/1981 | Blasberg et al. | 66/194 |
| 4,315,419 | 2/1982 | Kernbichler et al. | 66/87 |
| 4,393,582 | 7/1983 | Pickens, Jr. et al. | 428/94 |
| 4,437,269 | 3/1984 | Shaw | 51/358 |
| 4,467,625 | 8/1984 | Kurz | 66/193 |
| 4,528,809 | 7/1985 | Schwartz et al. | 57/207 |

(List continued on next page.)

FOREIGN PATENT DOCUMENTS

| | | | |
|---|---|---|---|
| 0 618 320 A2 | of 0000 | European Pat. Off. | D04B 21/02 |
| 0 091 273 | 10/1983 | European Pat. Off. | D04B 21/02 |
| 2 632 830 | 12/1989 | France | A44B 18/00 |
| 32 19 344 A1 | 11/1983 | Germany | B24D 9/08 |
| 2 285 093 | of 0000 | United Kingdom | A44B 18/00 |
| 1 091 050 | 11/1967 | United Kingdom | D04H 11/02 |
| 2 106 154 | 4/1983 | United Kingdom | D04H 11/00 |
| WO 95/19242 | 7/1995 | WIPO | B24D 9/08 |

*Primary Examiner*—Terrel Morris
*Attorney, Agent, or Firm*—James J. Trussell

[57] ABSTRACT

A back-up pad for supporting an abrasive article having projecting hooking stems. The back-up pad includes a support member and an engaging means provided on a major surface of the support member for releasable engaging the hooking stems of the abrasive article. The engaging means includes a substrate having a first surface, a second surface, a plurality of loops projecting from the first surface, and an adhesive applied to the second surface. The plurality of loops comprise a continuous strand, the strand including a plurality of loop portions projecting through the substrate from the second side to the first side to thereby form the loops, and a plurality of connecting portions between the loop portions. The substrate is located between the loop portions and connection portions of the strand, and the adhesive adheres the connecting portions of the strand to the second surface of the substrate. Also disclosed is an engaging means for use with a back-up pad, and a method of stitching the engaging means.

20 Claims, 4 Drawing Sheets

U.S. PATENT DOCUMENTS

| | | | |
|---|---|---|---|
| 4,609,581 | 9/1986 | Ott | 428/100 |
| 4,624,116 | 11/1986 | Rogers | 66/193 |
| 4,628,709 | 12/1986 | Aeschblach et al. | 66/9 R |
| 4,677,011 | 6/1987 | Matsuda | 428/88 |
| 4,705,710 | 11/1987 | Matsuda | 428/92 |
| 4,709,562 | 12/1987 | Matsuda | 66/193 |
| 4,714,096 | 12/1987 | Guay | 139/391 |
| 4,739,635 | 4/1988 | Conley et al. | 66/190 |
| 4,761,318 | 8/1988 | Ott et al. | 428/85 |
| 4,770,917 | 9/1988 | Tochacek et al. | 428/95 |
| 4,838,044 | 6/1989 | Matsuda et al. | 66/190 |
| 4,845,960 | 7/1989 | Schnegg | 66/84 A |
| 4,858,447 | 8/1989 | Matsuda | 66/191 |
| 4,881,383 | 11/1989 | Spillane et al. | 66/194 |
| 4,931,343 | 6/1990 | Becker et al. | 428/95 |
| 5,056,444 | 10/1991 | Lowry et al. | 112/221 |
| 5,119,643 | 6/1992 | Conley et al. | 66/190 |
| 5,201,149 | 4/1993 | Eishenblatter | 451/466 |
| 5,214,919 | 6/1993 | LaGreca | 112/410 |
| 5,214,942 | 6/1993 | Peake, III et al. | 66/194 |
| 5,254,194 | 10/1993 | Ott et al. | 156/176 |
| 5,256,231 | 10/1993 | Gorman et al. | 156/178 |
| 5,259,178 | 11/1993 | Sostegni | 57/24 |
| 5,267,453 | 12/1993 | Peake, III et al. | 66/194 |
| 5,308,574 | 5/1994 | Katoh et al. | 428/94 |
| 5,316,812 | 5/1994 | Stout et al. | 428/64 |
| 5,358,767 | 10/1994 | Bompard et al. | 428/86 |
| 5,392,498 | 2/1995 | Goulait et al. | 24/452 |
| 5,407,722 | 4/1995 | Peake, III et al. | 428/88 |
| 5,428,969 | 7/1995 | Day et al. | 66/202 |
| 5,436,050 | 7/1995 | Carriker et al. | 428/94 |
| 5,607,345 | 3/1997 | Barry et al. | 451/538 |

LOOP MATERIAL FOR ENGAGEMENT WITH HOOKING STEMS

This is a division of application Ser. No. 08/560,491 filed Nov. 17, 1995 now U.S. Pat. No. 5,692,949.

TECHNICAL FIELD

The present invention relates generally to a back-up pad for supporting an abrasive article and more particularly to a back-up pad provided with a loop component of a hook and loop fastening system for use with abrasive articles provided with a hook component of such a fastening system.

BACKGROUND OF THE INVENTION

Back-up pads are used in the abrasives field to support an abrasive disc or sheet during abrading. The term "abrading" as used herein includes all methods of material removal due to frictional contact between contacting surfaces in relative motion, such as grinding, sanding, polishing, burnishing, and refining. The abrasive articles can be any suitable abrasive article such as coated abrasives, lapping coated abrasives, or nonwoven abrasives. These abrasive articles can be in the form of a disc, sheet, or a polygon. The back-up pad includes a generally planar major surface, to which the abrasive article, such as a disc or sheet, may be attached. Although back-up pads may be hand held, back-up pads are more commonly used in conjunction with a powered abrading apparatus such as electric or pneumatic sanders.

Abrasive discs and sheets (hereinafter "discs") may be attached to a back-up pad in one of many different ways. One popular attachment method includes an abrasive disc having pressure sensitive adhesive (PAS) on one surface thereof, such that the abrasive disc may be adhered to the major surface of the back-up pad. The major surface of the back-up pad may have, for example, a smooth foam, vinyl, or cloth surface to facilitate attachment of the abrasive disc. An example of such a back-up pad is available from the Minnesota Mining and Manufacturing Company of St. Paul, Minn. under the designation "STIK-IT" brand back-up pad. An example of an abrasive disc for attachment to that back-up pad is available from the same company under the designation "STIK-IT" brand abrasive disc.

Although they have certain benefits, PAS abrasive discs and back-up pads have some limitations. For example, the PSA can be too aggressive in its adhesion to the back-up pad, such that the operator may be unable to remove all of the abrasive article from the back-up pad. If pieces of the disc backing or areas of PSA, or both, are left on the back-up pad, the resultant buildup can cause high spots on the back-up pad and present an uneven and unbalanced operating surface for receipt of a new abrasive disc. Another potential deficiency of the PSA back-up pad is that when PSA from the abrasive article remains on the back-up pad, the PSA can become contaminated with dust and debris, resulting in a "dead" spot onto which a new disc will not adhere, or an uneven surface that can tend to leave wild scratches in the workpiece. Thus, back-up pads adapted for receipt of a pressure sensitive adhesive backed abrasive disc may be undesirable.

A second type of back-up pad includes a major surface having a plurality of hooks projecting therefrom. The hooks are adapted to engage certain structures provided on the back face of an abrasive disc to releasably attach the disc to the back-up pad. An example of such a back-up pad is available from the Minnesota Mining and Manufacturing Company of St. Paul, Minn. under the designation "HOOK-IT" brand back-up pad, and an example of an abrasive disc for attachment to that back-up pad is available from the same company under the designation "HOOK-IT" brand abrasive disc.

The hook-faced back-up pad has certain advantages, such as ease of attachment and reattachment to the abrasive disc, but it also demonstrates certain potential disadvantages. For example, repetitive engagement and disengagement of the loop-backed abrasive results in the loop fabric breaking and depositing debris between the hooks, which decreases the useful life of the back-up pad. Thus, the hook faced back-up pad may also be undesirable for some applications.

Abrasive discs and back-up pads have conventionally been provided with hook and loop fastening systems in which the abrasive disc includes the loop component and the back-up pad includes the hook component. Alternatively, as disclosed in WIPO International Application Publication No. WO/95/19242, International Application No. PCT/US95/00521, "Abrasive Article, Method of Making Same, and Abrading Apparatus," the abrasive disc may be provided with the hook component and the back-up pad provided with the loop component.

The back-up pads described above are often used with dual action sanders ("DA sanders") which are well known in the art. Such sanders with back-up pads may be used for light duty sanding operations such as light sanding of painted surfaces between paint coats and sanding with very fine sandpaper to remove small paint imperfections such as dust nibs from the final paint coat. This type of sanding imparts little stress to the attachment interface. Such back-up pads may also be used for medium duty sanding operations such as final preparation of a workpiece surface for primer painting and sanding a workpiece surface having a primer paint thereon in preparation for subsequent painting. Light to medium downward pressures are typically applied during these types of sanding applications and impart a moderate amount of stress on the attachment interface. However, such sanders and back-up pads are often used under heavy duty sanding operations such as paint stripping or removing excess body filler where fairly heavy downward pressure would be applied by the operator. The back-up pad is often inclined at a relatively steep angle with respect to the workpiece surface and may also be pushed into crevices and over fairly sharp contours. The paint or body filler on the workpiece surface provides substantial resistance to the abrasive surface of the abrasive article attached to the back-up pad so that a considerable sanding force is often required to remove the paint or body filler. Such aggressive, heavy sanding operations apply substantial stress on the hook and loop attachment interface.

It is therefore desirable to provide a back-up pad having a loop material that attenuates the directionality of peel or engagement strength, that is durable enough to withstand a high number of attachments and removals of abrasive articles, and strong and durable enough to provide a sufficiently strong engagement with the abrasive article during high stress operations, while still allowing for easy removal of the abrasive article without substantial damage to the loop material.

SUMMARY OF THE INVENTION

One aspect of the present invention presents a back-up pad for supporting an abrasive article having projecting hooking stems. The back-up pad includes a support member including a major surface, and an engaging means provided on the major surface for releasably engaging the hooking stems. The engaging means includes a substrate having a first surface, a second surface, a plurality of loops projecting from the first surface, and an adhesive applied to the second surface. The plurality of loops comprise a continuous strand and the strand includes a plurality of loop portions projecting through the substrate from the second side to the first side to thereby form the loops and a plurality of connecting portions between the loop portions. The substrate is located between the loop portions and the connection portions of the strand, and the adhesive adheres the connecting portions of the strand to the second surface of the substrate. The strand can comprise a monofilament strand.

In one aspect of the above back-up pad, each of the loops lies in a respective plane defining the respective orientation of each of the loops, and the loops have respective orientations in at least two non-parallel directions. Such a back-up pad can include a first plurality of loops having an orientation in a first direction and a second plurality of loops having an orientation in a second direction non-parallel to the first direction. The back-up pad can also include loops having respective orientations in at least three non-parallel directions.

Another aspect of the present invention presents an engaging means as described above, for use with a back-up pad for supporting an abrasive article having projecting hooking stems.

A further aspect of the present invention presents a method of stitching an engaging means for use with a back-up pad for supporting an abrasive article having projecting hooking stems. The method comprising the steps of:

a) piercing a substrate at a first location with a needle in a direction from a first said of the substrate to a second side of the substrate;

b) engaging a strand on the second side of the substrate with the needle;

c) pulling a first portion of the strand from the second side of the substrate through the substrate to a first side of the substrate, thereby forming a first loop;

d) causing relative translation between the needle and the substrate;

e) piercing the substrate at a second location of the substrate with the needle;

f) engaging the strand on the second side of the substrate with the needle;

g) pulling a second portion of the strand from the second side of the substrate through the substrate to a first side of the substrate, thereby forming a second loop;

h) simultaneous to step g), applying sufficient pressure against said substrate and strand to prevent pulling through the substrate portion of the strand forming the first loop; and i) adhering a portion of the strand to the second side of the substrate.

A still further aspect of the present invention presents an alternate method of stitching an engaging means for use with a back-up pad for supporting an abrasive article having projecting hooking stems. The alternate method comprises the steps of:

a) piercing a substrate at a first location with a needle in a direction from a first said of the substrate to a second side of the substrate, wherein the needle includes an eyelet with a strand held therein;

b) engaging the strand on the second side of the substrate with a looper;

c) retracting the needle from the second side of the substrate through the substrate to the first side of the substrate while holding the strand with the looper, d) disengaging the looper from the strand thereby forming a first loop;

d) causing relative translation between the needle and the substrate;

e) piercing the substrate at a second location with the needle in a direction from the first said of the substrate to the second side of the substrate;

f) engaging the strand on the second side of the substrate with a looper;

g) retracting the needle from the second side of the substrate through the substrate to the first side of the substrate while holding the strand with the looper, h) disengaging the looper from the strand thereby forming a second loop;

i) adhering a portion of the strand to the second side of the substrate.

Certain terms are used in the description and the claims that, while for the most part are well known, may require some explanation. The term "strand" as used herein refers to the thread, yarn, filament, or like element that forms the loops in the loop component of the hook and loop fastening system. The term "strand" includes both multifilament and monofilament strands. The term "multifilament" as used herein refers to a strand which comprises a plurality of individual "filaments" combined together. The term "monofilament" as used herein refers to a strand comprising a single filament. The "denier" is a unit of fineness used to describe various strands, and is based on a standard of 50 milligrams per 450 meters of strand.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE INVENTION

The back-up pad of the present invention includes a major surface, also referred to as the front surface, which is adapted to releasably engage with hooking stems that project from any desired abrasive article, such as a disc or sheet. Preferred abrasive articles having such hooking stems are disclosed in International Application Publication No. WO/95/19242, discussed above. The abrasive article is supported by the back-up pad for use in abrading the surface of a workpiece. The back-up pad can be configured for use as a hand pad or for use with any suitable power drive means.

Figure 1:
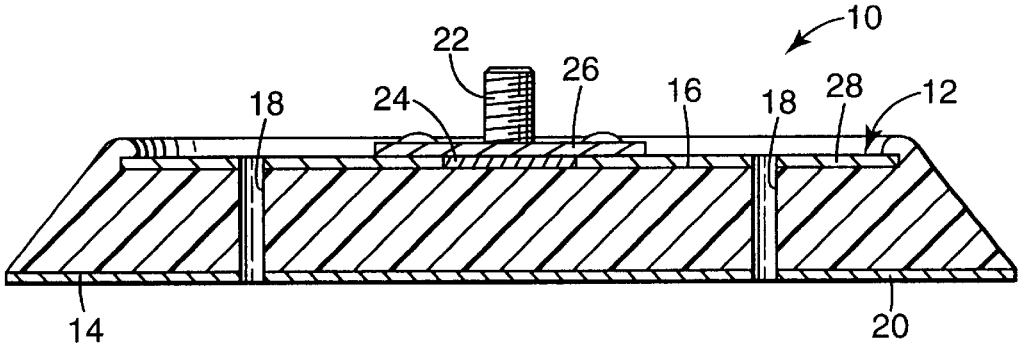
FIG. 1 is an elevation view of a back-up pad according to the present invention.

As shown in FIG. 1, the back-up pad 10 of the present invention generally includes a support member 12 and an engaging means 20. Support member 12 includes a major surface 14, and preferably a minor surface 16. Major surface 14 is shown as planar, but could have any suitable topography. The support member major surface may, for example, contain raised portions that increase the force applied to the work surface per area of the abrasive article, and can produce increased material removal rates. The shape of the back-up pad face typically is the same as the shape of the abrasive article to be carried by the back-up pad, although this is not required. Some popular back-up pad shapes include a square, a triangle, a rectangle, an oval, a circle, a pentagon, a hexagon, an octagon, and the like.

The diameter for a circular back-up pad 10 typically ranges from about 1.25 to 125 cm (0.5 to 50 inches), preferably from about 2.5 to 75 cm (1 to 30 inches). The length and/or width of a non-circular back-up pad is usually on the same order, and can range from about 1.25 to 125 cm (0.5 to 50 inches), typically about 2.5 to 75 cm (1 to 30 inches). The back-up pad may also have a slightly smaller diameter than the abrasive article. For example, the abrasive article may overhang the back-up pad by a very slight amount—typically less than 0.25 cm (0.1 inch), and preferably less than 0.13 cm (0.05 inch). The thickness of the support member is typically in the range of 0.6 to 12.5 cm (0.25 to 5.0 in), although larger and smaller thicknesses are possible. The thickness of the support member may also vary at different locations of the back-up pad.

The support member may be designed for use with a desired abrading application. For example, for wood and some metal sanding, the support member of the back-up pad is typically made of a compressible, resilient material, such as open and closed cell polymeric foams (such as soft closed cell neoprene foam, open cell polyester foam, polyurethane foam, reticulated or non-reticulated slabstock foams), rubber, porous thermoplastic polymers, and the like. Preferred polyurethane-based foams include toluene diisocyanate (TDI) based foam and methylene di (or bis) phenyl diisocyanate (MDI) based foam. For some applications, it is desirable to construct the support portion from a more rigid material, to facilitate the transmission of abrading forces in a localized area, such as for heavy stock removal or relatively high pressure abrading. Examples of suitable rigid materials include steel (including stainless steel and mild steel), hard rubbers, vulcanized rubbers, thermosetting polymers such as crosslinked phenolic resins, ceramics, laminated or pressed fibers, and the like.

The support member may also include an optional facing which protects the support member 12 and anchors the engaging member 20 to the back-up pad. The front facing may comprise such materials as cloth, nonwoven substrates, treated cloth, treated nonwoven substrates, polymeric films, and the like. Preferred front facing materials include nylon coated cloths, vinyl coated nonwovens, vinyl coated woven fabrics, and treated woven fabrics.

If the back-up pad 10 is intended to be mounted on a machine for movement thereby, the back-up pad will typically have some type of mechanical attachment means on minor surface 16. For instance, for random orbital applications the support member may include a threaded shaft 22 adjoining the minor surface and projecting orthogonally therefrom. The threaded shaft may be engaged with the output shaft of the machine, and the back-up pad secured to the machine thereby. Other attachment means are also possible, including but not limited to an unthreaded shaft, a threaded nut, a threaded washer, adhesives, and magnets. A backing plate 28 may also be provided, and may overlie the minor surface 16 as shown in FIG. 1 to provide added rigidity to the back-up pad. In such an embodiment, shaft 22 has head 24 retained to the back-up pad by retainer 26 that is riveted to the support plate 28. Alternately, the backing plate 24 may be incorporated into the support member to provide additional rigidity.

If the back-up pad is intended to be used by hand, the support member can include a handle that makes the apparatus easier to manipulate. The handle is typically provided in place of the attachment means described in the preceding paragraph, but could instead be secured to the attachment means. Other suitable handle configurations can be provided as desired.

The back-up pad may also include one or more holes, apertures, or passageways through which dust, debris, or an abrading fluid (such as water or oil) may be removed from the abrading surface. Passageways 18, shown in FIG. 1, are typically connected to a vacuum source that removes any generated dust and debris from the abrading surface. A mating abrasive article typically includes holes in a size and pattern matching the passageways in the back-up pad of the present invention. U.S. Pat. Nos. 4,184,291 and 4,287,685, the contents of which are incorporated herein by reference, further describe such dust removal passageways and holes. Passageways may also or instead be provided for the provision or removal of water or other lubricants or grinding aids.

The back-up pad of the invention also includes an engaging means 20 adjoining major surface 14. Engaging means 20 facilitates the releasable attachment of an abrasive article described further below. Engaging means 20 may directly adjoin or be integral with major surface 14, or may be bonded to optional front facing or to other intermediate layers that are bonded to major surface 14. Although engaging means 20 may take one of many different forms, each embodiment shares the common feature that the engaging surface is adapted for releasable engagement with a plurality of hooking stems. As used herein, a hooking stem means a stem having 1) a free end that is spaced from the surface to which the stem is attached, and 2) a structure that enables the hooking stem to releasably hook the features of the engaging surface. Two particular structures that enable a hooking stem to releasably hook the engaging surface, as described in International Publication No. WO 95/19242 discussed above, are a head adjoining each stem, or a stem having an included distal end angle of less than approximately 90 degrees. It should be noted that it is not necessary that all of the hooking stems must engage with the engaging surface, but a sufficient number of hooking stems should be engaged to enable the abrasive article to be easily attached to and detached from the back-up pad, while preventing the abrasive article from shifting significantly relative to the back-up pad during use.

Figure 2:
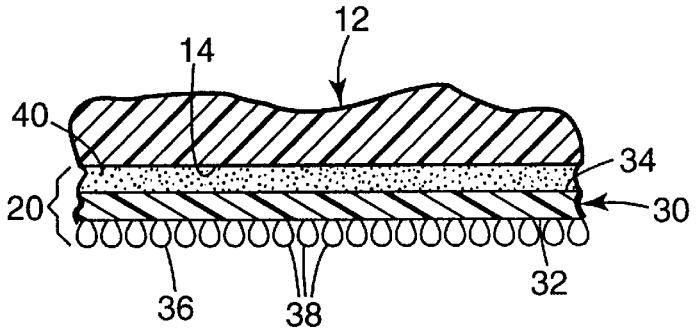
FIG. 2 is an enlarged partial cross-sectional view of the engaging means portion of the back-up pad of FIG. 1.

One preferred embodiment of an engaging member 20 adapted for releasable engagement with a plurality of hooking stems is illustrated in FIG. 2. Engaging means 20 includes a substrate 30. Substrate 30 can be any suitable substrate to which strand 36 may be stitched to form a plurality of loops 38 extending from first surface 32 of substrate 30. Substrate 30 should be chosen to allow the needle to penetrate the substrate when forming loops 38, to provide adequate support for the loops, to provide an adequate bond with adhesive layer 40 described in more detail below, and to avoid picking and snagging by the needle when forming loops 38. Preferred materials for substrate 30 include woven fabrics such as polyester, fortrel polyester gabardine, 65/35 polyester/cotton blend poplin, rip stop nylon, cotton canvas, polyester double knit, 50/50 cotton/polyester blend, cotton twill, and woven cellulosic fabric, such as cotton or rayon, in a 2 over 1 twill weave having a weight of 165 grams/meter$^2$. Loops 38 are configured to releasably engage the hooking stems of the back side of the abrasive article to attach the abrasive article to the back-up pad 10.

In one preferred embodiment, the engaging means 20 is secured to the major surface 14 of the support member 12 by an adhesive 40. For example, a laminating adhesive can be used to secure the loop fabric to the support member. Examples of suitable laminating adhesives include polyolefins, polyesters, polyurethanes, polyamides, phenolic adhesives, urea-formaldehyde adhesives, epoxy adhesives, acrylate adhesives and the like. One embodiment of a suitable back-up pad is available from the Minnesota Mining and Manufacturing Company of St. Paul, Minn., under the designation "STIK-IT" brand back-up pad, part number 051144-05576, to which engaging means 20 can be laminated with, for example, a polyacrylate pressure sensitive adhesive. In another preferred embodiment, the support member 12 is formed around and bonded to the engaging means 20 in a manner similar to that used in making back-up pads that are available from the Minnesota Mining and Manufacturing Company of St. Paul, Minn. under the designation "HOOK-IT" brand back-up pad, part number 051131-05776. For instance, a polyurethane material can be foamed directly to the back side of the engaging means 20. If the support member 12 is foamed directly to the engaging means 20, the back side of the engaging means should be selected or treated to prevent the foam, such as a polyurethane foam, from bleeding through to the loop side of the engaging means. It is undesirable to have the foam material on and around the loops 38. One way to attenuate foam bleed-through is to apply a coating to the back of the stitched substrate to seal it. This coating can be a thermoplastic or thermosetting polymeric material, for example. This sealant layer can be the adhesive 40 which locks the loops 38 as explained further below, or can be an additional coating provided on top of the adhesive layer 40.

The engaging means 20 preferably is durable, exhibits good holding power, and allows simple attachment and detachment of the abrasive article. Durability is an important parameter, because the back-up pad may be attached to and detached from hundreds or thousands of abrasive articles during its lifetime. Because the abrasive articles are disposable, meaning that they are usually discarded after one or a few uses, the durability of the back-up pad is more important than the durability of the abrasive article. Thus, it is preferred that the back-up pad 10 and particularly the engaging means 20, be durable enough to withstand 1000 or more heavy duty sanding uses, each use comprising attaching an abrasive article, performing heavy duty sanding for a period, and removing the abrasive article for attachment of a fresh abrasive article, although this desired life is not a requirement of the present invention. The back-up pad, and particularly the engaging means, should permit the abrasive article to be removed with a small amount of force, but should resist movement relative to the abrasive article during use.

The height of the loops 38 (i.e. the approximate average distance from the base of the loop to the top of the loop) typically ranges from about 0.025 cm (0.010 inch) to 0.625 cm (0.25 inch), preferably 0.063 cm (0.025 inch) to 0.45 cm (0.175 inch), and more preferably between 0.125 cm (0.05 inch) to 0.325 cm (0.15 inch). If the loop height is too large, it could allow the abrasive article to release and reattach during use, which can cause the abrasive article to "shift" and "walk" during use. This can decrease abrading performance and life of the abrasive article. Additionally, when the loops are too high they may act as a cushion or buffer allowing the abrasive article to shift relative to the back-up pad during operation while remaining engaged by the engaging means 20. This can reduce abrasive performance by damping the abrading action. If the loop height is too small, there may not be sufficient attachment of the hooking stems and the loop fabric. The preferred loop dimensions will depend upon the shape and type of hooking stems provided and on the desired engagement characteristics, and may be larger or smaller than those just described while remaining within the scope of the present invention.

The loop density may also be selected to provide suitable performance characteristics. For example, the density of the loops can be the same as or different from the density of the hooks. The loop density usually ranges between about 30 and 4000 loops per cm$^2$ (about 200 to 25,000 loops per inch$^2$), preferably between 100 and 3000 loops per cm$^2$ (about 65 to 1900 loops per inch$^2$), and more preferably between 50 and 150 loops per cm$^2$ (about 325 to 970 loops per inch$^2$). If the loop density is too high, the cost of the loop fabric typically increases, and it may be difficult to remove the abrasive article from the back-up pad without damaging one or the other component. If the loop density is significantly too high, it may be difficult for the hooks on the abrasive article to sufficiently penetrate the loops to become adequately engaged. If the loop density is too low, the peel and shear strength may be too low, which could decrease performance due to the insufficient attachment force.

Figure 3A:
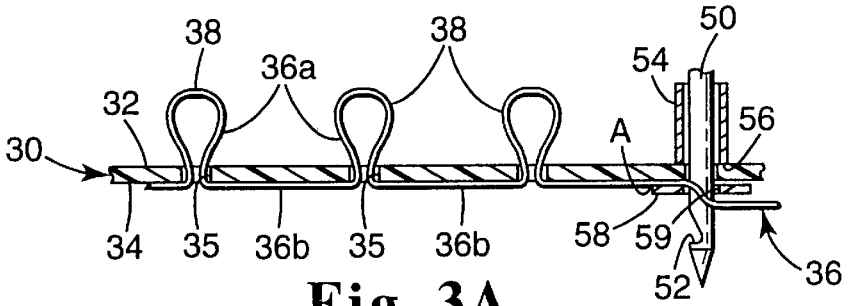
FIGS. 3A and 3B are partially schematic views of a method and apparatus for making the engaging means portion according to the present invention.
Figure 3B:
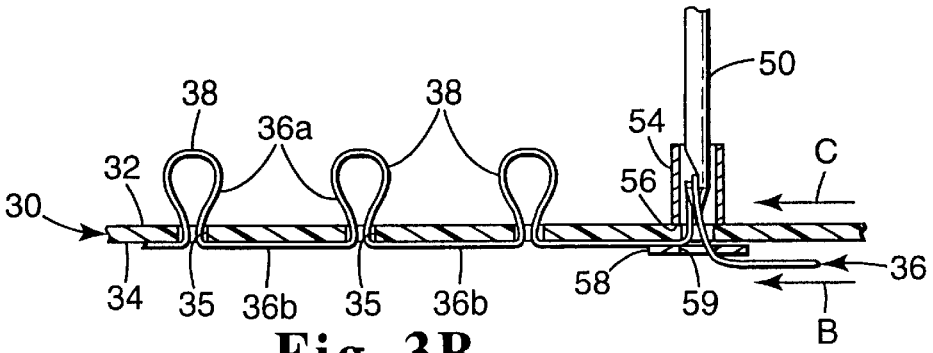

A preferred method of forming loops 38 in substrate 30 is illustrated schematically with respect to FIGS. 3A–3B. In general, loops 38 are formed by repeatedly piercing the substrate 30 and causing portions of the strand 36 to extend through the substrate 30, such as with a suitable needle, thereby forming a plurality of loops 38 formed from a continuous strand 36. The strand 36 thus includes loop portions 36*a* forming the loops 38 and connecting portions 36*b* between each of the loop portions 36*a*. Such loops can be preferably formed with commercially available stitching machines of the type generally known as "chenille stitch" machines. As seen in FIG. 3A, loops 38 are formed from strand 36 in substrate 30 so as to extend from the first surface 32 of the substrate. A chenille needle 50 has an open sided hook 52 on the end of the needle so that the strand 36 can enter and exit from the side of the needle point. The basic operation of one type of a chenille machine is for the needle 50 to penetrate through the substrate 30 thereby forming a hole 35. A looping mechanism (not illustrated) places the strand 36 in the side hook 52 of the needle 50. At the same time, a hollow nipple 54 which encompasses needle 50 pushes down against the first surface 32 of the substrate 30 with edge 56. Plate 58 is positioned underneath needle 50 and nipple 54. Plate 58 has a hole 59 through which the needle and hook extend to receive the strand 36 to form a new loop. The plate 58 and nipple 54 are configured to provide a pinch at A to the substrate and strand between the plate and nipple. The needle 50 then pulls the strand 36 up through the hole 35 in substrate 30 to a desired height as illustrated in FIG. 3B. Because of the pinch at A, strand 36 is not pulled in the direction from the already formed loops 38. The strand 36 feeds in direction B through hole 59 in plate 58 as the needle 50 pulls the newly formed loop through hole 35 into the interior of nipple 54. The hook 52 in needle 50 is oriented to release or "drop" the strand 36 of the newly formed loop 38 while the substrate 30 is moved in direction C. The result is a free standing loop 38. This type of stitch is generally referred to as a drop stitch or a moss stitch. After the substrate 30 has been moved to a new location a new stitch or loop 38 is formed. The result is a series of free standing loops 38 made from a single continuous strand 36. The loops are generally oriented in the direction defined from hole 35 to hole 35 of adjacent loops. The orientation of each loop 38 is defined as the plane formed by strand 36 in each loop. Under some conditions, hook 52 on needle 50 may snag fibers in substrate 30 and pull these substrate fibers up while forming a loop 38. It has been observed that by varying factors such as hook style, needle diameter, hook orientation, height adjustment of the nipple, and the type of fabric used for the substrate, it may be possible to attenuate snagging. It is currently believed that tightly knit or woven flat fabric substrates, which may also comprise flat yarns, are less prone to snagging than are other types of substrates such as twill fabrics.

Figure 8A:
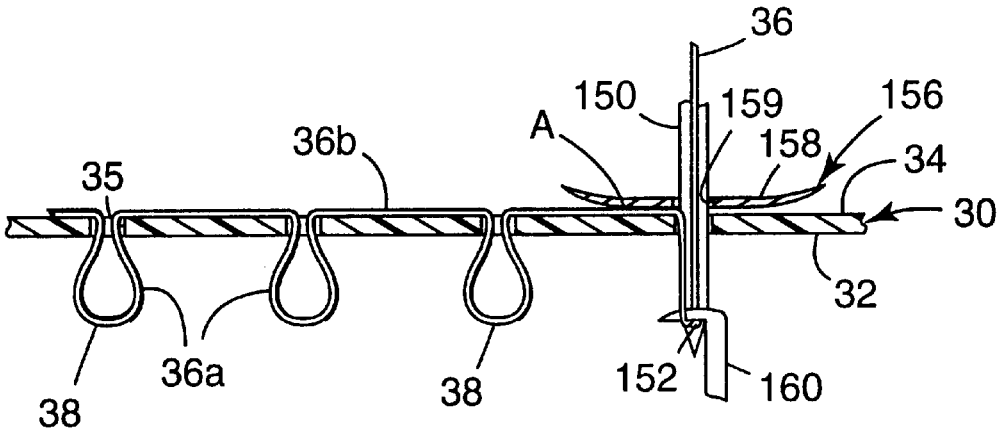
FIGS. 8A and 8B are partially schematic views of a method and apparatus for making the engaging means portion according to the present invention.
Figure 8B:
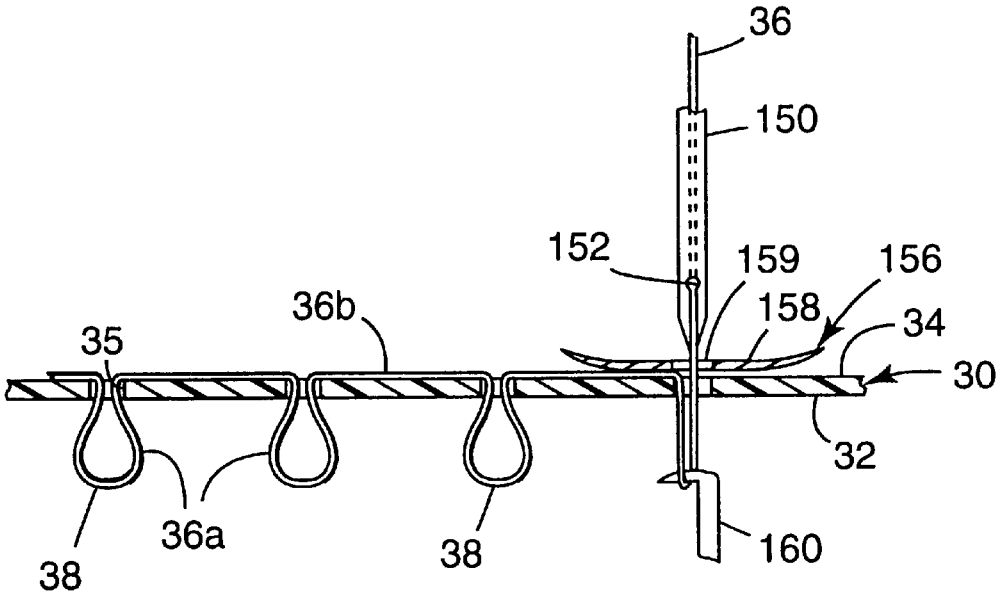

A second preferred method of forming loops 38 in substrate 30 is illustrated schematically with respect to FIGS. 8A–8B. In general, loops 38 are formed by repeatedly piercing the substrate 30 and causing portions of the strand 36 to extend through the substrate 30, such as with a needle, thereby forming a plurality of loops 38 formed from a continuous strand 36. The strand 36 thus includes loop portions 36*a* forming the loops 38 and connecting portions 36*b* between each of the loop portions 36*a*. Such loops can be preferably formed with the commercially available Broad Street Model 30—30 Head chenille stitch machines. As seen in FIG. 8A, loops 38 are formed from strand 36 in substrate 30 so as to extend from the first surface 32 of the substrate. A chenille needle 150 has an eyelet 152 near the end of the needle so that the strand 36 goes through the needle. The basic operation is for the needle 150 to penetrate through the substrate 30 thereby forming a hole 35. A looping mechanism 160 hooks the strand 36 at the side of the needle 150. During the entire cycle, a presser foot 158 pushes down against the second surface 34 of the substrate 30 with surface 156. The presser foot 158 is configured to provide a pinch at A to the substrate and strand. The needle 150 then retracts up through the hole 35 in substrate 30 with strand 36. Looper 160 holds the strand 36 to form the desired length of the loop. Because of the pinch at A, strand 36 is not pulled in the direction from the already formed loops 38. The looper 160 releases the strand thereby creating a free standing loop 38. After the substrate 30 has been moved to a new location a new stitch or loop 38 is formed. The result is a series of free standing loops 38 made from a single continuous strand 36. The loops are generally oriented in the direction defined from hole 35 to hole 35 of adjacent loops. The orientation of each loop 38 is defined as the plane formed by strand 36 in each loop.

Figure 4:
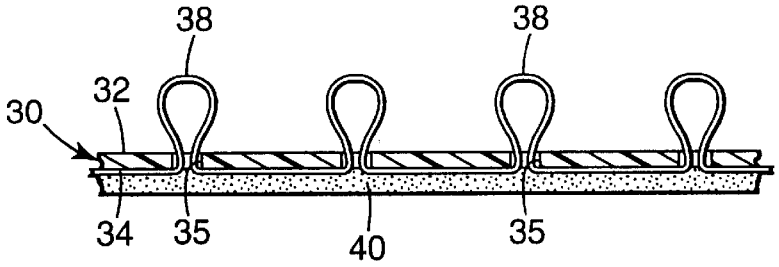
FIG. 4 is a cross sectional view of a preferred engaging means according to the present invention.

Often, sewing and embroidery operations employ a second strand in a bobbin below the substrate which locks each individual stitch. However, the chenille stitch method described above does not lock each loop 38. Accordingly, the loops 38 are connected to one another, but are not tied or locked in place. If one loop 38 is pulled up through the substrate 30, it will pull the strand 36 from adjacent loops. It is therefore necessary to lock all of the loops 38 in place. This is preferably done by adding adhesive layer 40 to second surface 34 of substrate 30 after forming the loops 38. Such an arrangement is illustrated in FIG. 4. The adhesive should be chosen to satisfy the following criteria. The adhesive should provide a strong enough bond to lock the stitches and prevent pull out of loops 38 during operation of the sander and during removal of abrasive articles from the back-up pad 10. The adhesive should be sufficiently heat resistant so as to not be adversely affected by the heat generated during the manufacturing process and during sanding operations. For back-up pads in which the engagement means 20 is foamed into the support member 12, the adhesive should not be adversely affected by the heat generated during the foam-in and cure of the support member, and should not react with or be degraded by the material of the support member 12 in such a way as to adversely affect the adhesive or the support member. When the engaging means is to be foamed-in when making the support member 12 of the back-up pad, it is preferred to apply sufficient adhesive either as a single layer 40 or multiple layers 40 to seal the porosity of the stitched substrate 30 thereby minimizing or eliminating bleed-through of the foamed material during the foam-in process. Suitable types of adhesives include, but are not limited to, polyolefins, polyesters, polyurethanes, polyamides, phenolic adhesives, urea-formaldehyde adhesives, epoxy adhesives, acrylate adhesives, and the like. Particular examples of such adhesives include latex acrylonitrile/butadiene/styrene (ABS) adhesives such as "Hycar 1578", available from B. F. Goodrich Company of Akron, Ohio; latex based acrylic adhesives such as "Hycar 2679" also available from B. F. Goodrich Company; latex based styrene/butadiene (SBR) adhesives such as REZ 5900 available from Unocal Corp. of Rolling Meadow, Ill.; EAA hot melt adhesives such as DAF 821 or DAF 916 hot melt adhesives available from Dow Chemical Company of Midland, Mich.; two part epoxies such as WD 510 available from Shell Chemical Company of Houston, with Jaffamine T403 available from Huntsman Chemical Corp. of Salt Lake City, Utah; and 2 part reactive polyurethane adhesives such as Versalink 1000 available from Air Products and Chemical Corporation of Allentown, Pa. with Isonate 143L from Dow Chemical Company; Ribbon Flow RFA 1000 with RFB 090 available from Uniroyal Chemical Co., Inc. of Middlebury, Conn. It is also possible to provide an optional coating, film, or tightly woven facing on the exposed surface of adhesive layer 40 to further seal the substrate 30 and to protect and isolate the adhesive during foam-in process.

With commercially available chenille machines, the substrate 30 can be moved in any direction after each stitch. Thus, the loops 38 can be made to have an orientation in any direction. This provides the ability to closely control the orientation of the loops and to stitch engaging means 20 in which loops 38 are oriented in different directions relative to one another by a desired amount. It has been observed that with conventional loop material used in hook and loop fasteners, the stitch pattern is generally unidirectional. However, with conventional multifilament strands, the bending that occurs when forming loops may cause the loop to twist away from the initial stitch orientation somewhat, and causes individual filaments of the strand to unwind and separate somewhat from the body of the multifilament strand itself The orientation of the individual exposed loops is substantially varied and is not controlled or predetermined. It is desirable to provide a loop material having an engagement strength which is not substantially dependent on the peel or release direction. This is especially so with back-up pads 10 used with rotary sanders, DA sanders, orbital sanders, vibratory sanders, and the like. Chenille machines can be advantageously used to form a loop pattern which attenuates or eliminates the directionality of peel strength or engagement strength by forming a loop pattern which is not unidirectional by conveniently forming a stitch loop pattern of desired multidirectionality.

Figure 5:
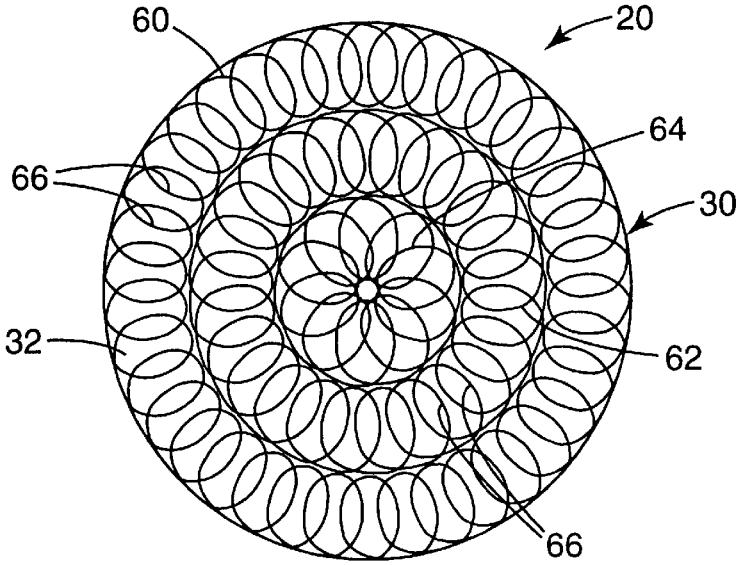
FIG. 5 is a plan view of one preferred embodiment of the engaging means according to the present invention.

One preferred embodiment of a multidirectional loop stitch pattern is illustrated in FIG. 5. A circular substrate 30 is provided. Such a substrate can have a 16.5 cm (6.5 inch) diameter, for example. The outer portion 60 of each substrate 30 can be stitched first using a series of circles 66 about 2.5 cm (1 inch) diameter, with each circle 66 offset by approximately 5.1 mm (0.2 inches) from the previous one until the entire outer portion 60 of the substrate 30 was filled. This will leave an unstitched circular area of approximately 11.4 cm (4.5 inches) diameter. The first step can be repeated to stitch another 2.54 cm (1.0 inch) wide ring comprising a plurality of overlapping circles 66 in intermediate portion 62. The remaining 6.4 cm (2.5 inch) diameter central portion 64 can then be filled using circular motions. Such a pattern can conveniently be used to vary the loop density. For example, it is possible to make three passes in the outer portion 60 of circles 66, two passes in the intermediate portion 62, and a single pass in the central portion 64. Such patterns can be formed, for example, on a chenille stitch hand-controlled sewing machine available commercially from Singer Sewing Company, Edison, N.J.

Figure 6:
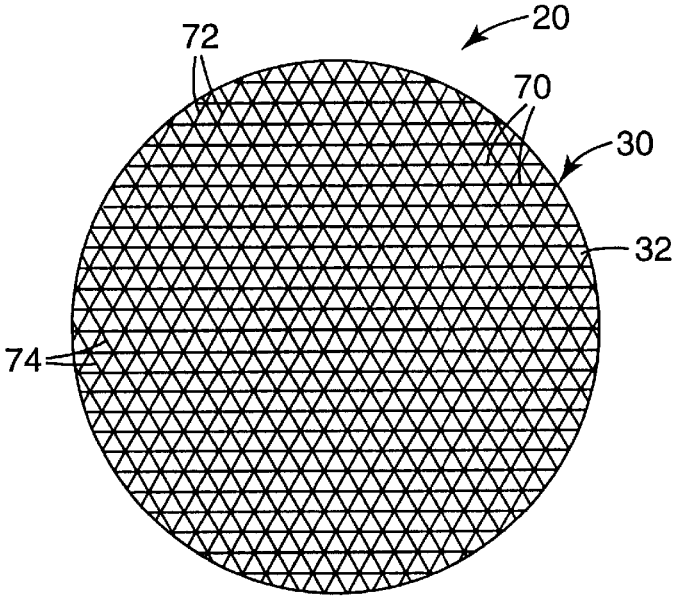
FIG. 6 is a plan view of a second preferred embodiment of the engaging means according to the present invention.

Another preferred embodiment of a multidirectional loop stitch pattern is illustrated in FIG. 6. A circular substrate 30 is first stitched with a first plurality of loops having the same orientation. This first plurality is formed by stitching a first plurality of evenly spaced, parallel lines 70 stitched in one direction, parallel to the X axis. In one preferred arrangement, the adjacent lines are separated by approximately 3.6 mm (0.14 inches), with the loops in each line having a base separated by approximately 0.42 mm (0.16 inches), as determined by the spacing of adjacent holes 35. A second plurality of loops is provided having the same orientation as one another, different from the orientation of the first plurality of loops. The second plurality of loops is formed by stitching a second plurality of evenly spaced, parallel lines 72 at an angle of 60 degrees to the first plurality of lines 70. A third plurality of loops is provided having the same orientation as one another, different from the orientation of the first and second pluralities of loops. The third plurality of loops is formed by stitching a third plurality of evenly spaced, parallel lines 74 at an angle of 120 degrees to the first plurality of lines 70. Alternatively, any number of pluralities of spaced parallel lines may be stitched. A single plurality of lines may be suitable for operations in which shifting caused by unidirectionality of the loops is not caused, or where a small amount of shifting is acceptable. Two or more pluralities of parallel lines are preferred where it is desired to minimize the effects of directionality. When more than three pluralities are formed, the effects of directionality may be further reduced depending on the intended use. It is also possible to vary the stitch length within a line and/or the spacing of lines within a plurality of lines or from plurality to plurality. It is also possible to stitch a plurality of individual lines which are each of a different orientation relative to the X axis.

For commercially available, computer-controlled chenille stitching machines, the area of the substrate to be filled is digitized and then the area can be filled in a variety of patterns. There are several fill functions typically built into the software. The general practice for filling areas with computer-controlled chenille machines is to fill with straight line stitching as described with respect to the embodiment illustrated in FIG. 6. This results in a very uniform loop array. Such patterns can be made, for example, with a Melco single head computer controlled chenille stitching machine, model number CH1, available from Melco Embroidery Systems of Denver, Colo.; or with multiple head chenille stitching machines available from Tajima Industries Ltd., or Higashi-ku, Hagoya, Japan, such as 12 head model number TMCE-112423. In both of these commercially available machines, the substrate 30 is mounted into a frame that is moved under the stationary sewing heads by means of an X-Y transport mechanism. The transport mechanism motion is computer controlled. Loop heights can be adjusted on the above identified computer-controlled machines with programmed height settings. Stitch length (the distance from hole 35 to adjacent hole 35 in a line of stitched loops) and spacing between adjacent lines of loops are also program adjustable. These two parameters determine the loop density. The loop height and density can be chosen to provide the desired engagement characteristics for the particular hooks on the abrasive article to be mounted on the back-up pad 10. The pattern described above with respect to FIG. 6 can be obtained by setting the computer program parameters on these machines as follows: fill pattern: fill 4; density: 36.0; length: 24; angle: 30.

One preferred method of making the engaging means 20 is to stitch the loops 38 into a substrate 30 somewhat larger than the size of the back-up pad. After attaching the engaging means 20 to the support member 12, the engaging means can be trimmed to the diameter of the support member. For example, a 16.5 cm (6.5 inch) substrate 30 can be joined to a 15.2 cm (6.0 inch) back-up pad and then trimmed to the diameter of the back-up pad. When using a multiple head stitching machine, it is possible to stitch a number of loop patterns simultaneously onto a large substrate 30. These individual stitched areas of the substrate can then be separated, such as by die cutting for example, for subsequent attachment to the support member 12.

The back-up pad of the present invention is preferably used with any abrasive article having hooks projecting from one surface thereof which can be engaged by the engaging means 20 of the present invention. The abrasive article 80 could have any desired shape, including but not limited to a circle, an oval, a polygon (such as a rectangle, square, or a star), or a multi-lobed shape (such as a daisy). The abrasive article 80 includes a working surface 82 and a back surface 84 having hooking stems 90. Preferred abrasive articles include those disclosed in International Publication No. WO 95/19242 discussed above.

Figure 7:
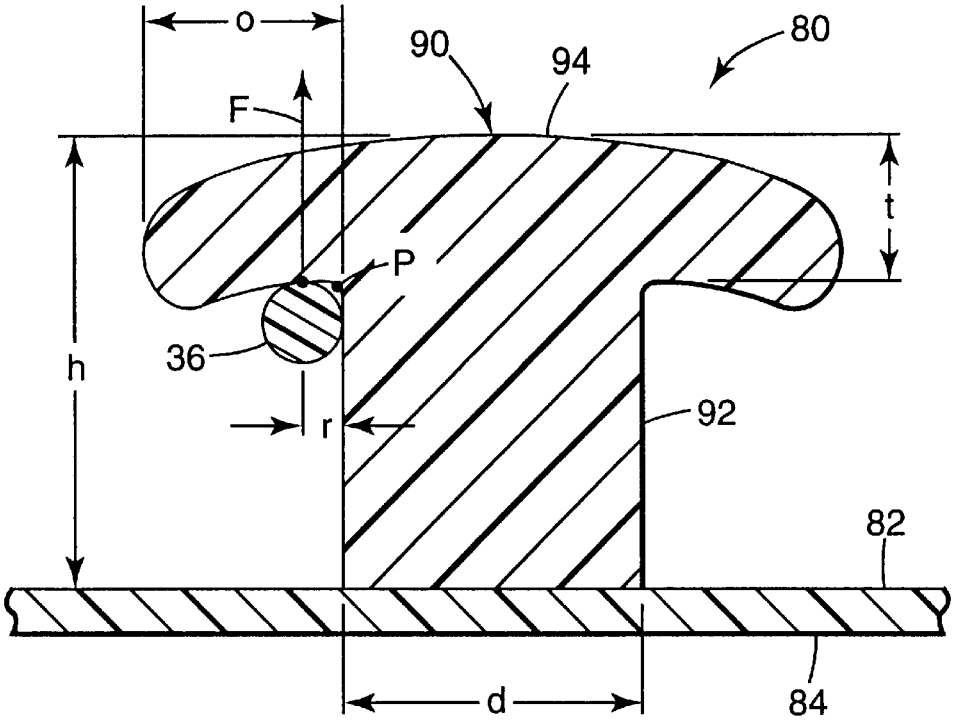
FIG. 7 is a cross-sectional view of an abrasive article with a hook engaged by the engaging means according to the present invention.

The various embodiments of the engaging means 20 described herein are well-suited for use with abrasive articles having hooks of the general shape illustrated in FIG. 7. In the illustrated embodiment, hook 90 comprises a cylindrical stem 92 having a head 94 generally in the form of a disc or mushroom head. The head 94 overhangs the stem 92. Hook 90 can be of the following dimensions. Total hook height (h) of from 0.51 to 0.66 mm (0.020 to 0.026 inches), head thickness (t) of from 0.075 to 0.10 mm (0.003 to 0.004 inches), a stem diameter (d) of from 0.38 to 0.64 mm (0.015 to 0.025 inches), with the head overhanging the stem at (o) by approximately 0.075 to 0.15 mm (0.003 to 0.006 inches). The engaging means described with respect to FIGS. 5 and 6, and having the following dimensions, are particularly well-suited for use with such hooks 90: preferred loop height of from 1.8 to 3.0 mm (0.070 to 0.118 inches); and preferred stitch density of from about 55 to 85 loops per $cm^2$ (350 to 550 loops per $inch^2$), and more preferably approximately 70 loops per $cm^2$ (450 loops per $inch^2$). It is to be understood however, that other loop stitch patterns and dimensions can be chosen within the scope of the present invention and may be varied for particular hook shapes and dimensions other than as illustrated, and for particular engagement characteristics as desired.

An additional advantage to using chenille stitching to form loops 38 is that it is possible to vary the density of loops 38 within a back-up pad 10, or to omit loops from portions, such as the center portion. It is believed that a higher loop density near the circumference of the back-up pad 10 will provide increased engagement strength which may not be needed toward the center of the back-up pad.

It is believed a primary cause of loop failure is the rigorous vibrational action of the DA sander combined with the large resistive sanding forces of removing paint or body filler during heavy sanding applications. Each vibrational action results in an impulse force being applied to the loops so that when there is large resistance to the motion of the abrasive surface, a correspondingly large impulsive force is transmitted to the loops. The DA sander vibrates hundreds of times per minute thus imparting hundreds of large impulses per minute to the loops. This repetitive stress can cause fatigue failure of the loops.

It has been observed that back-up pads including commercially available loop material such as Guilford 19073 loop material having loops formed from a knitted 200-10 multifilament nylon yarn (i.e. yarn having a 200 denier consisting of a twisted bundle of 10 individual filaments of 20 denier each), available commercially from Guilford Mills Company, of Greensboro, N.C., and Kanebo 2A3 loop material having loops formed from a knitted 210-12 nylon yarn, available from Kanebo Belltouch Ltd., of Osaka, Japan, perform acceptably in terms of initially maintaining an acceptable engagement during various types of sanding operations. However, after approximately 200–300 heavy duty sanding uses with a DA sander, numerous loops were found to be broken, reducing the strength of the engagement between the disc arid the back-up pad to the point that there was an unacceptable amount of disc creasing or complete detachment of the disc from the back-up pad. Even though the individual filaments of the multifilament yarn are twisted together, the process of forming the loops from the yarn opens up the bundle somewhat thereby exposing many of the individual filaments as possible attachment sites for hooks. In the Guilford 19073 loop material, the diameter of each individual filament is 0.05 mm (1.95 mils) and a typical overhang of an individual hook used to test the material is approximately 0.13 mm (5 mils). It was observed by the present inventors that a typical hook and loop engagement generally consists of 1–3 filaments engaging the hook head, with a large number of the engagements consisting of only a single filament. If a complete and tightly wound bundle of 10 filaments engaged the hook head, the loop would easily slide off during detachment and provide little or no holding power, or all but a few individual filaments would slide off with only a few (1–3) remaining engaged with the hook. Therefore the tensile or breaking strength of the individual filament is an important parameter to consider in evaluating the engagement strength of a loop material, even when multifilament strands are employed. The tensile strength of individual filaments is a major factor in determining how large of an impulse imparted during sanding forces can be endured without breaking loops of filaments that are engaged to a hook. Another factor is the elasticity or resilience of the strand which can allow the strand to absorb impulses and resist failure better than more brittle strands.

The present inventors have determined that the following analysis is useful in selecting the strand 36 to form the loops 38. FIG. 7 illustrates a strand 36 forming a loop 38 engaged with a hook 90. Loop 38 can comprise a monofilament strand 36, or a single filament from a multifilament strand 36, and has a radius (r). In the illustrated embodiment, hook 90 comprises a cylindrical stem 92 having a head 94 generally in the form of a disc or mushroom head. The head 94 overhangs the stem 92 by amount (o). As the strand 36 pulls against the overhanging portion of the head with force, F, the engaged portion of the head 92 bends in the direction of the force applied by the loop. As the head 92 bends upward it will reach a point where the strand 36 can slide off the hook head. If, however, the force required to bend the head sufficiently far to allow loop slippage is greater than the breaking strength of the strand 36, then the strand will break before it slips off the head.

It is useful to consider the applied loop force, F, as imparting a bending moment or torque to the hook about the point P. A breaking torque, T, about point P can be approximated as $$T=F_B R$$

where $F_B$ is the tensile or breaking strength of the strand 36 and R is the radius of the strand 36. It is understood that causing the head to bend is actually a three-dimensional problem and that the above two-dimensional approximation of this effect is made for illustrative purposes in explaining loop release from the hook. It is not intended that actual torque calculations be performed with the above equation other than for relative comparison purposes. The maximum torque T that can be applied to a given hook depends on the maximum force F that can be applied by the strand 36 before the strand breaks and by the radius of the strand. If a sufficient torque can be applied to bend the head and allow the loop to slip off, then loop breakage can be avoided. If, however, the strand 36 is not capable of applying sufficient torque, the strand will break before it slips off the hook. It is seen that given a strong enough strand to impart sufficient torque to allow the strand to slip off, a relatively large radius strand will impart the required torque with a relatively small force, while a strand with a small diameter will require a higher force to apply the same torque.

For durability of the engaging means 20, it is preferred that the strand 36 have a strength and diameter selected to be able to impart a sufficient torque to the intended hook on the abrasive article to allow the loops 38 to slip off the hook 90 without breaking the strand. For a back up-pad engaging means 20 to provide a secure engagement to the abrasive article during heavy duty sanding operations, the diameter of the strand 36 should be chosen such that sufficient torque to allow the loop to slip off is not imparted by the forces during sanding. Also, the strand 36 should have sufficient strength to withstand the repetitive stresses imparted during sanding operations.

In one preferred embodiment, strand 36 comprises a monofilament strand. Monofilament strands provide greater control of loop orientation when stitching loops 38 into substrate 30. Multifilament strands are typically a twisted bundle of filaments. Individual filaments of the twisted bundle are prone to partially separating from the loop as the bundle is bent to form the loop, and during use of the engaging means. These separated loops may be at any orientation because of the twist in the bundle. A monofilament will have a predetermined orientation. For engagement means 20 to be used with the hook 90 having the configuration and dimensions described above, it has been found advantageous to use a monofilament strand 36 of 80 denier nylon, 0.1 mm (4 mil) diameter, although the present invention is not thereby limited. Such a strand has been found to withstand the numerous large impulsive forces imparted by heavy duty DA sanding while having a diameter small enough to provide sufficient engagement strength during operation. Such a strand is also capable of imparting sufficient torque to the hook 90 to allow the loop 38 to slip off without breaking the strand. Monofilament strands of smaller diameter than 0.1 mm (4 mils) would be adequate to withstand the forces imparted by medium or light duty sanding operations, provided the diameter is sufficiently large to impart the required torque to the hook to allow the loop to slip off without breaking the strand. Monofilament strands of larger than 0.1 mm (4 mils) diameter may not provide adequate engagement during heavy duty sanding because the forces imparted by heavy duty sanding in combination with a sufficiently large diameter may impart sufficient torque to the hook to allow the loop 38 to slip off during operation, but may be suitable for medium or light duty sanding operations. It is therefore seen that monofilament strands of less than or greater than 0.1 mm (4 mils) will be useful for certain sanding operations and hook geometries and are within the scope of the present invention. Preferred monofilament strands include, but are not limited to, nylon monofilaments available commercially from Shakespeare Monofilament Division of Anthony Industries, Columbia, S.C., including SN-40 (50 denier) and SN-40 (80 denier).

In another preferred embodiment, the strand 36 comprises a multifilament strand. The multifilament strand preferably ranges from about 15 to 600 denier, and more preferably between 100 and 300 denier. Because one or more filaments or yarns may break when the abrasive article is removed from the back-up pad as explained above, it is preferred that there be a sufficient number of filaments in a yarn to provide a long lasting back-up pad. There are preferably between 2 to 34 filaments in a single yarn. The denier of each filament usually ranges from about between 2 to 100, and more preferably between 10 to 30 denier.

The material from which the monofilament or multifilament strand 36 is made may be selected as desired, and can include such organic materials as thermoplastic and thermosetting materials like polyamides (such as nylon), polyolefins, polyurethanes, aramids, polyester, cellulosic materials, or such inorganic materials as metal (including aluminum or steel) or ceramic (including glass and fiberglass). The strand may also be a combination of different materials. The strand may be straight, curved, or twisted, and may contain a surface treatment of some type, such as an antistatic coating, or silicone. The surface coating may be selected to aid in the stitching process.

The operation of the present invention will be further described with regard to the following detailed examples. These examples are offered to further illustrate the various specific and preferred embodiments and techniques. It should be understood, however, that many variations and modifications may be made while remaining within the scope of the present invention.

EXAMPLES

Unless otherwise specified, the following examples were prepared by adhering an engaging means to the vinyl face of a 3M STIK-IT back-up pad, available commercially from Minnesota Mining and Manufacturing Company, St. Paul, Minn. as part number 051144-5576), with Panel Adhesive Compound 30 (PAC 30), also from 3M as part number 051135-08456.

The abrasive disc attached to the engaging means was of the type available from the Minnesota Mining and Manufacturing Company of St. Paul, Minn., under the designation 3M 255L "STIK-IT" brand Gold Film abrasive disc. Various grades were used as reported below. The abrasive disc included a layer of polyacrylate pressure sensitive adhesive on the rear face thereof, to which a backing layer having a plurality of hooking stems was adhered. The hooking stems were generally as described above with respect to FIG. 7, having a density of 50 hooking stems per $cm^2$ (324 per $inch^2$), a stem diameter of 0.43 mm (0.017 inch), a total height of 0.53 mm (0.021 inch), with the head overhanging the stem by 0.075 to 0.15 mm (0.003 to 0.006 inches).

It was observed that back-up pads including commercially available loop material such as Guilford 19073 loop material having loops formed from a knitted 200-10 nylon yarn (i.e. yarn having a 200 denier consisting of a twisted bundle of 10 individual filaments of 20 denier each), available commercially from Guilford Mills Company, of Greensboro, N.C., and Kanebo 2A3 loop material, a knitted nylon 210-12 yarn, available from Kanebo Belltouch Ltd., of Osaka, Japan, performed acceptably in terms of initially maintaining an acceptable engagement during various types of sanding operations. However, after approximately 200–300 heavy duty sanding uses with a DA sander, numerous loops were found to be broken reducing the strength of the engagement between the disc and the back-up pad to the point that there was an unacceptable amount of disc creasing or complete detachment of the disc from the back-up pad. In the case of medium sanding application, it has been observed that the above commercially available loop materials lasted approximately 600 cycles before excessive loop failure occurred.

It is therefore apparent that two experimental test procedures would be useful. The three-mode test described below provides an indication of whether a particular hook and loop fastening system is strong enough to survive a short term test designed to place high stress on the engaging means. Fastener systems that performed adequately in the three mode test were then tested under the accelerated life test described below. This test provides an indication of whether the back-up pad engaging means is durable enough to withstand a very high number of sanding cycles and abrasive disc removals and attachments.

Three Mode Test Procedure

Step 1) An abrasive disc as described above was attached to the back-up pad of a dual action air sander of the type available from National-Detroit Inc., of Rockford, Ill., under the designation DAQ, using two firm pats by the operator's hand. The abrasive disc was then removed from the back-up pad and replaced on the back-up pad, again using two firm pats by the operator's hand. The placement, removal, and replacement steps were intended to simulate repetitive use of the abrasive disc, and to simulate repositioning a disc that had been mispositioned.

Step 2) The abrasive disc was rotated by the pneumatic dual action sander, wherein the dynamic air pressure at the tool (the air pressure with the back-up pad allowed to rotate freely) was approximately 42 newtons per square centimeter (60 pounds per square inch). The abrasive face of the rotating abrasive disc was contacted to a flat, 14 gauge steel panel, at approximately a 5 degree angle between the panel and the plane of the abrasive disc. This was designated Mode 1, and the sanding continued at a force of approximately 110 N (25 lb.) for a period of approximately 15 seconds. The sanding action was from side-to-side for a total of 7.5 seconds (at approximately 1 second per sweep), and toward and away from the operator for a total of 7.5 seconds (at approximately 1 second per sweep).

Step 3) Following Step 2), the abrasive face of the abrasive disc was examined for evidence that the disc had puckered, creased, or wrinkled, and a grade was assigned to the condition of the abrasive disc based on the following criteria.

Grade 5: Superior, with no significant puckering (separation of the disc from the back-up pad) or wrinkling (creases in the disc). The abrasive disc stayed firmly attached to the back-up pad during the test.

Grade 4: Slight wrinkling of the abrasive disc, with either the center or the edge of the disc noticeably separated from the back-up pad.

Grade 3: Noticeable puckering (up to 25% of the disc separated from the back-up pad) or wrinkling (one or two creases with lengths less than 25% of the diameter of the disc).

Grade 2: Severe wrinkling and puckering of the abrasive disc; less than 50% of the disc in contact with the back-up pad.

Grade 1: Unacceptable; the abrasive disc detached from the back-up pad during the test.

Step 4) The abrasive disc was detached from the back-up pad of the dual action air sander, and then Step 1) was repeated.

Step 5) Repeat Step 2), except that the angle between the panel and the plane of the abrasive disc was 10 degrees.

Step 6) Repeat Step 3).

Step 7) Repeat Step 4).

Step 8) Repeat Step 2), except that the angle between the panel and the plane of the abrasive disc was 45 degrees.

Step 9) Repeat Step 3).

Any rating of 1 or 2 during any of the 3 modes signifies that the engaging means is unacceptable for normal use with the particular abrasive article because the engaging means could not adequately withstand the test conditions, which were intended to simulate actual abrading applications. A rating of 3 or 4 during one of the 3 modes indicates that the engaging means may be acceptable for some applications, but may be unacceptable for other applications where wrinkling of the abrasive article is not tolerable. Thus, an acceptable engaging means typically should be rated a 5 in at least two of the three test modes.

Accelerated Life Test Procedure

This test subjected back-up pads with engaging means to a controlled grinding operation designed to provide an accelerated life test. The test proceeded until the engaging means on the back-up pad was unable to hold the abrasive article in place during the abrading process. The test procedure was as follows:

Step 1) A dual action air sander of the type available from National Detroit Inc., of Rockford, Ill., under the designation DAQ, was attached to a vertical slide arm. The back-up pad was then attached to the DAQ air sander. The slide arm mechanism was suspended above a sanding surface with air pressure. The total weight of the sander and slide arm assembly was 9.1 kg (20 pounds). The sanding surface was an acrylic sheet mounted on an X-Y table. The dynamic air pressure to the pneumatic DAQ air sander (the air pressure with the back-up pad allowed to rotate freely) was set to approximately 42 newtons per square centimeter (60 pounds per square inch). Then the sander was turned off.

Step 2) An abrasive disc as described above (grade 80) was attached to the engaging means of the back-up pad using two firm pats of the operator's hand.

Step 3) The air cylinder holding up the sander was opened allowing the sander to come down and rest upon the sanding surface under its weight of 9.1 kg (20 pounds). The x-y table and DA sander were activated just prior the sanding disc contacting the workpiece. The sander was mounted on the vertical slide mechanism such that the abrasive face of the rotating abrasive disc contacted the acrylic sheet at an angle of approximately 20 degrees. The sanding cycle consisted of 16 sweeps in the X direction, each sweep including a back and forth pass of 20 cm (8 inches), the complete back and forth sweep taking one second. At the completion of each back and forth sweep, the table was moved 12.7 mm (0.5 inches) in the Y direction. After 16 such sweeps in the X direction, the table then made 16 such sweeps in the Y direction and moved in 12.7 mm (0.5 inches) in the X direction per each Y sweep. This cycle resulted in a 20 by 20 cm (8 by 8 inch) square portion of the workpiece being sanded four times. The total time for a complete cycle is approximately 2 minutes and 10 seconds. The vertical slide was raised at the completion of each cycle to remove the sander from the workpiece.

Step 4) The abrasive disc was removed from the back-up pad, and reattached to the back-up pad using two firm pats by the operator's hand. The abrasive disc was replaced with a new abrasive disc after every third sanding cycle.

Step 5) Repeated Step 3) and Step 4) until the attachment system between the loop fabric and the hooking stem failed. Failure is defined as the abrasive disc having less than approximately 50% of the disc contacting the back-up pad, having heavy or significant creasing, or the disc becoming completely detached during the test.

COMPARATIVE EXAMPLES 1–11

Example 1

An engaging means was stitched generally in accordance with the teachings of U.S. Pat. No. 4,609,581, "Coated Abrasive Sheet Material With Loop Attachment Means," (Ott) using a Malimo™ stitchbonding machine available from Malimo of Germany. The loops were stitched into a nonwoven fabric substrate available as Confil™ type 9408335 from Veratec Company of Boston, Mass., with Shakespeare style SN-38 nylon monofilament yarn 150 (denier). Loop density was 60 stitches per 10 centimeters and loop height was 3 mm.

Three mode test results:

grade 100 abrasive: 5/1/- Abrasive article fly-off in second mode.
grade 180 abrasive: 5/3/1 Shifting in second mode, fly off in third mode. Disc removal before sanding was acceptable.

Example 2

Example 1 was repeated with the exception that the loops were stitched with Kevlar™ 49 aramid type 965 multifilament yarn available from E. I. Du Pont de Nemours and Company, Inc., Wilmington, Del.

Three mode results (grade 100 abrasive):

5/5/3 Some shifting and creasing.
Disc removal before and after sanding was very difficult.
Many loops were broken during removal of the sanding disc.

Example 3

Example 1 was repeated with the exception that loops were stitched with Spectra™ 1000 multifilament yarn (215-60) available from Allied Signal Inc. of New York, N.Y.

Three mode results (grade 100 abrasive):

5/5/3 Some shifting and creasing.
Disc removal before and after sanding was very difficult.
Many loops were broken during removal of the sanding disc.

The Spectra yarn consisted of a bundle of filaments each having a 0.023 mm (0.91 mil) diameter. The bundle was flat (i.e. the filaments were not twisted together) and was extremely difficult to handle in a stitchbonding operation. The filaments are very brittle and hence difficult to sharply bend when forming the loops. Filaments broke easily in the stitching operation and quickly clogged the yarn guides and pathway causing very frequent stops to clear and rethread. The discs were very difficult to pull off the engaging means, and each removal of a disc resulted in numerous filaments being broken. Sanding with the disc locked the loops on tighter making it even more difficult to remove the abrasive article.

Example 4

The engaging means comprised a loop fabric knitted on a 3-bar weft insertion style machine. The first bar, or warp bar, which is used to produce the loop contained Shakespeare SN-38 nylon monofilament yarn (80 denier). The second bar, or ground bar, contained 150-34 denier texturized polyester yarn. The third bar, or welt bar, which is used to tie the loops in place, contained a 150-34 denier texturized polyester yarn. A number of samples were made and tested in which loop densities varied between 29.5 to 59 loops per square centimeter (190 to 380 loops per square inch), and loop height varied between 1.5 to 3.5 mm (0.060 to 0.138 inches).

Three mode results (grade 100 abrasive):

5/3/2 Excessive shifting and creasing in third mode on all samples.

Example 5

The engaging means comprised a loop fabric stitched on a circular knit machine. A Shakespeare style SN-38 nylon monofilament (80 denier) was used for the loops.

Three mode results (grade 100 abrasive):

5-3-1 Flyoff in third mode.
Disc removal both before and after sanding was very easy.
The loop density appeared to be too dense, preventing sufficient loop and hook engagement for good peel strength.

Example 6

The engaging means comprised a warp knit fabric produced on a standard 3-bar tricot machine. Shakespeare style SN-38 nylon monofilament (50 denier) was used on the front bar to form the loops. A 60 denier polypropylene 34 filament yarn was used on the ground bar and a 70 denier polyester 34 filament yarn was used on the cross bar. Loop height was 3 mm (0.118 inches) and loop density was 54 loops per square centimeter (350 loops per square inch). The samples was heat set after knitting.

Three mode results (grade 100 abrasive):

5-5-2 Excessive shifting and creasing in third mode.
Disc removal both before and after sanding was acceptable.

Example 7

The engaging means comprised a warp knit fabric produced on a standard 4-bar tricot machine. The loop was produced with a Shakespeare style SN-38 nylon monofilament (80 denier) on the front bar. The ground bar contained a 150 denier polyester 34 filament yarn. One cross bar contained a 70 denier polyester 34 filament yarn and the second cross bar contained a 60 denier polypropylene 34 filament yarn. Loop height was 3 mm (0.118 inches) and loop density was 54 loops per square centimeter (350 loops per square inch). The sample was heat set after knitting.

Three mode results:

| | | |
|---|---|---|
| grade 80 abrasive: | 5/1/- | Disc flyoff in second mode |
| grade 180 abrasive: | 5/3/1 | Excessive shifting in second mode<br>Flyoff in third mode |
| grade 320 abrasive: | 5/3/2 | Excessive shifting and creasing in third mode |

Disc removal both before and after sanding was acceptable.

Example 8

The engaging means comprised a loop fabric stitched on a commercially available Arachne stitchbonding machine. The loops were formed by stitching Shakespeare style SN-40 nylon monofilament (50 denier) into a polyester woven fabric substrate (46 grams/sq. meter). Stitch density was 60 stitches per 10 cm (15.24/inch) and stitch height was 2 mm (0.80 inches).

Three mode results (grade 100 abrasive)

5/5/2 Excessive shifting and creasing in third mode.

Example 9

Example 8 was repeated with the exception that the loops were stitched with Shakespeare style SN-40 nylon monofilament (80 denier).

| Three mode results (grade 100 abrasive) | |
|---|---|
| 5/5/2 | Excessive shifting and creasing in third mode. |

Example 10

The engaging means comprised a woven loop fabric produced on a Raschelina warp knitting machine with weft insertion available from Jacob Mueller of America Inc., of Charlotte, N.C. The engaging means was woven with an 80 denier nylon monofilament Shakespeare style SN-40 as the loop yarn, a texturized nylon 100-34 yarn as the ground yarn and a texturized nylon 140-34 yarn as the cross yarn. Loop height was 2.5 mm (0.1 inches). There were 45 picks per inch and 316 monofilament ends across the 2 inch wide loop structure. The loop structure was then heat set.

| Three mode results (grade 100 abrasive) | |
|---|---|
| 5/5/1 | Excessive shifting and creasing in third mode. |

Example 11

The engaging means comprised style 19073 loop fabric from Guilford Mills with loops formed by 200-10 nylon multifilament strands from Allied Signal.

| Three mode results: | | |
|---|---|---|
| grade 80 abrasive | 5/5/5 | Minimal shifting and wrinkling |
| grade 180 abrasive | 5/5/5 | Minimal shifting and wrinkling |
| Accelerated wear test results: | | |
| Excessive loop breakage after 100 cycles resulting in disc flyoff even under low angle (mode 2) sanding. | | |

All samples of Comparative Examples 1–11 had loops that had a substantially unidirectional orientation, that is, facing primarily in one direction. During three mode testing and sanding, these samples exhibited a tendency to shift on the pad during use and to wrinkle unacceptably, generally in a direction parallel to the plane of the loops. During some extended sanding operations, many of these engaging means would allow the abrasive disc to shift or "walk" in one direction and sometimes gradually work their way off the back-up pad.

EXAMPLES 12–15

Example 12

The engaging means was stitched using a Singer hand controlled chenille stitching machine. The loop was formed from Shakespeare style SN-40 nylon monofilament yarn (50 denier) stitched into a canvas substrate. A 6.5 inch diameter portion of the substrate was filled with a series of circular motions of about one inch in diameter slightly offset from each other as described above with respect to the embodiment shown in FIG. 5. The outer one inch wide band was filled by going around the sample three times, the middle one inch wide band was filled with two passes, and the central 2.5 inch diameter circle was filled with just one pass. The stitch density was approximately 60 stitches per $cm^2$ (400 stitches per $inch^2$) in the outer portion, approximately 40 stitches per $cm^2$ (270 stitches per $inch^2$) in the intermediate portion and approximately 20 stitches per $cm^2$ (135 stitches per $inch^2$) in the central area. The stitch height was approximately 3 mm (0.118 inches). The stitched loops were then locked in place by applying to the back side of the substrate four 0.09 mm (0.0035 inch) thick layers of ethylene acrylic acid (EAA) hot melt adhesive available from Dow Chemical as type DAF 916 hot melt adhesive film.

| Three mode results: | | |
|---|---|---|
| grade 80 abrasive | 5/5/5 | No shifting or wrinkling |
| grade 180 abrasive | 5/5/5 | No shifting or wrinkling |
| Accelerated wear results: | | |
| Considerable loop breakage after 300 cycles. | | |
| Three mode test after 300 cycles: 5/5/3 | | |

Example 13

Example 11 was repeated with the exception that the loops were stitched from Shakespeare style SN-40 nylon monofilament (80 denier).

| Three mode results: | | |
|---|---|---|
| grade 80 abrasive | 5/5/5 | No shifting or wrinkling |
| grade 180 abrasive | 5/5/5 | No shifting or wrinkling |
| Accelerated wear results: | | |
| Considerable loop breakage after 1000 cycles. | | |
| Three mode test results after 1000 cycles: 5/5/3 | | |

Example 14

The engaging means was stitched with a Melco single head computer controlled chenille stitching machine available from Melco Embroidery Systems of Denver, Colo. A three pass stitching pattern as described with respect to the embodiment of FIG. 6 was used. The loop height was approximately 2 mm (0.08 inches). The first pass filled a circular portion of the substrate with parallel lines using a computer stitch length setting and line spacing of 2.2 mm (0.087 inches), resulting in a loop density of approximately 20 loops per $cm^2$(133 loops per inch) on each pass. The second pass filled the circular area with a series of parallel lines at an angle of 60 degrees to the first pass. The third pass was similar but at an angle of 120 degrees to the first pass. This resulted in a total loop density of approximately 60 loops per $cm^2$(400 loops per $inch^2$), with loops facing three directions much like the faces of an equilateral triangle. The loops were locked by applying four layers of DAF 916 hot melt film. The sample was then foamed-in to the support member of a back-up pad generally in accordance with the manufacturing process for making 3M part number 051131-5776 HOOK-IT brand back-up pads (hook-faced back-up pad).

Three mode test results (100 grade abrasive): 5-5-5

Example 15

The engaging means was stitched using a computer controlled multiple head chenille stitching machine available from Tajima Industries Ltd., Japan. A three pass pattern similar to example 14 was used but with a stitch length computer setting of 24 mm, spacing of 36 mm and a computer program fill pattern of F4. This resulted in a stitch density of approximately 70 loops per $cm^2$ (450 loops per $inch^2$). Loop height was 2.3 mm (0.09 inches). The stitched loops were locked by applying Hycar 2679 water based latex resin available from B. F. Goodrich Company to the back of the substrate. The sample was then foamed-in to the support member of a back-up pad generally in accordance with the manufacturing process for making 3M part number 051131-5776 HOOK-IT brand back-up pads (hook-faced back-up pad).

Three mode test results (100 grade abrasive): 5 -5 -5.

EXAMPLES A AND B

For Example A, a back-up pad was provided with an engaging means stitched with a Malimo™ stitchbonding machine, available from Malimo of Germany, with the loops comprising a Spectra™ 215-60 yarn available from Allied Signal. The individual filaments of this yarn are reported by the manufacturer to have a tensile strength of 126 grams and a 0.023 mm (0.91 mils) diameter.

For Example B, a back-up pad was provided with an engaging means comprising Guilford 19073 material described above, comprising a 200-10 nylon yarn supplied by Allied Signal comprising individual filaments reported to have a breaking strength of 96 grams, and a 0.05 mm (1.95 mils) diameter.

A much larger force was observed to be necessary to peel the disc off of the back-pad of Example A than from Example B. Additionally, many more loops of the back-up pad of Example A were broken in the process of each removal. The smaller diameter filaments in the 215-60 yarn in Example A were required to impart a greater force to achieve sufficient torque to allow the loop to slip off The larger diameter filaments of the 200-10 yarn in Example B allowed the filaments apply a sufficient torque with a smaller force to allow the loop to slip off Accordingly, more filaments of the 215-60 yarn were observed to be broken during disengagement, despite the higher breaking strength of the individual filaments. This validated the analytical technique described above for considering the interrelationship of the filament diameter, filament strength, and removal force.

The present invention has now been described with reference to several embodiments thereof The foregoing detailed description and examples have been given for clarity of understanding only. No unnecessary limitations are to be understood therefrom. It will be apparent to those skilled in the art that many changes can be made in the embodiments described without departing from the scope of the invention. Furthermore, the present invention may be used with any type of abrasive article to perform any desired abrading operation on type of workpiece surface. Thus, the scope of the present invention should not be limited to the exact details and structures described herein, but rather by the structures described by the language of the claims, and the equivalents of those structures.

What is claimed is:

1. A loop material for releasable engagement with hook stems, said loop material comprising:

a substrate having a first surface, a second surface, a plurality of drop stitch loops projecting from said first surface, and an adhesive applied to said second surface;

wherein said plurality of loops comprise a strand, said strand including a plurality of loop portions projecting through said substrate from said second side to said first side to thereby form said loops and a plurality of connecting portions between adjacent ones of said loop portions, said substrate being located between said loop portions and said connection portions of said strand, and wherein said adhesive adheres said connecting portions of said strand to said second surface of said substrate.

2. The loop material of claim 1, wherein said strand comprises a monofilament strand.

3. The loop material of claim 1, wherein each of said loops lies in a respective plane defining the respective orientation of each of said loops, and wherein a plurality of said loops have respective orientations in at least two non-parallel directions.

4. The loop material of claim 3, wherein said loop material includes a first plurality of loops having an orientation in a first direction and a second plurality of loops having an orientation in a second direction non-parallel to said first direction.

5. The loop material of claim 4, wherein said first plurality of loops comprises at least two parallel lines of loops having an orientation parallel to said first direction and wherein said second plurality of loops comprises at least two parallel lines of loops having an orientation parallel to said second direction.

6. The loop material of claim 3, wherein a plurality of said loops have respective orientations in at least three non-parallel directions.

7. The loop material of claim 4, further comprising a third plurality of loops having an orientation in a third direction non-parallel to said first and second directions.

8. The loop material of claim 7, wherein said third plurality of loops comprises at least two parallel lines of loops having an orientation parallel to said third direction.

9. The loop material of claim 8, wherein said first, second, and third directions are each at an angle of approximately 60 degrees to the other two directions.

10. The loop material of claim 1, wherein the density of said loops is from about 55 to 85 loops per $cm^2$.

11. The loop material of claim 1, wherein the height of said loops is from about 1.8 to 3.0 mm.

12. The loop material of claim 1 in combination with a back-up pad for supporting an abrasive article having projecting hooking stems, said back-up pad comprising a support member including a major surface, wherein said loop material is provided on said major surface of said back-up pad.

13. A loop material for releasable engagement with hook stems, said loop material comprising:

a substrate having a first surface, a second surface, a plurality of drop stitch loops projecting from said first surface, and an adhesive applied to said second surface;

wherein said plurality of loops comprise a monofilament strand, said strand including a plurality of loop portions projecting through said substrate from said second side to said first side to thereby form said loops and a plurality of connecting portions between adjacent ones of said loop portions, said substrate being located between said loop portions and said connection portions of said strand, and wherein said adhesive adheres said connecting portions of said strand to said second surface of said substrate;

wherein the density of said loops is from about 55 to 85 loops per $cm^2$ and the height of said loops is from about 1.8 to 3.0 mm; and wherein each of said loops lies in a respective plane defining the respective orientation of each of said loops, and wherein a first plurality of said loops have an orientation parallel to a first direction, a second plurality of said loops have an orientation parallel to a second direction, and a third plurality of loops have an orientation parallel to a third direction, wherein said first, second, and third directions are non-parallel to one another.

14. The loop material of claim 13, wherein said first plurality of loops comprises at least two parallel lines of loops having an orientation parallel to said first direction, wherein said second plurality of loops comprises at least two parallel lines of loops having an orientation parallel to said second direction, and wherein said third plurality of loops comprises at least two parallel lines of loops having an orientation parallel to said third direction.

15. The loop material of claim 14, wherein said first, second, and third directions are each at an angle of approximately 60 degrees to the other two directions.

16. The loop material of claim 13 in combination with a back-up pad for supporting an abrasive article having projecting hooking stems, said back-up pad comprising a support member including a major surface, wherein said loop material is provided on said major surface of said back-up pad.

17. A loop material for releasable engagement with hook stems, said loop material comprising:

a substrate having a first surface, a second surface, a plurality of drop stitch loops projecting from said first surface, and an adhesive applied to said second surface;

wherein said plurality of loops comprise a strand, said strand including a plurality of loop portions projecting through said substrate from said second side to said first side to thereby form said loops and a plurality of connecting portions between adjacent ones of said loop portions, said substrate being located between said loop portions and said connection portions of said strand, and wherein said adhesive adheres said connecting portions of said strand to said second surface of said substrate;

wherein each of said loops lies in a respective plane defining the respective orientation of each of said loops, and wherein a plurality of said loops have respective orientations in at least two non-parallel directions.

18. The loop material of claim 17, wherein a plurality of said loops have respective orientations in at least three non-parallel directions.

19. The loop material of claim 17, wherein said strand comprises a monofilament strand.

20. The loop material of claim 17 in combination with a back-up pad for supporting an abrasive article having projecting hooking stems, said back-up pad comprising a support member including a major surface, wherein said loop material is provided on said major surface of said back-up pad.

* * * * *

UNITED STATES PATENT AND TRADEMARK OFFICE

CERTIFICATE OF CORRECTION

PATENT NO. : 5,962,102 
DATED : October 5, 1999
INVENTOR(S) : William F. Sheffield, John L. Barry and David F. Slama It is certified that error appears in the above-identified patent and that said Letters Patent is hereby corrected as shown below:

Title page,
Item [56], References Cited, U.S. PATENT DOCUMENTS,
"5,214,919" should read -- 5,241,919 --, please insert the following -- 5,616,155, 4/1997, Kronzer, 428/100 --, -- 5,383,872, 1/1995, Roessler et al., 604/391 --, -- 5,001,804, 3/1991, Roeker et al., 428/95 -- and -- 4,404,999, 9/1983, Woodall, Jr. et al., 428/92 --

Column 10,
Line 61, after "itself" add -- . --

Column 13,
Line 37, "arid" should read -- and --

Column 19,
Line 47, "welt" should read -- weft --

Column 23,
Line 37, after "off" add -- . --
Line 40, after "off" -- . --
Line 47, after "thereof" add -- . --

Signed and Sealed this

Thirteenth Day of August, 2002

*Attest:*

*Attesting Officer*

JAMES E. ROGAN
*Director of the United States Patent and Trademark Office*